US006304042B1

(12) United States Patent
Savage et al.

(10) Patent No.: US 6,304,042 B1
(45) Date of Patent: Oct. 16, 2001

(54) PLASMA OPENING SWITCH

(75) Inventors: Mark E. Savage; Clifford W. Mendel, Jr., both of Albuquerque, NM (US)

(73) Assignee: Sandia Corporation, Albuquerque, NM (US)

( * ) Notice: Subject to any disclaimer, the term of this patent is extended or adjusted under 35 U.S.C. 154(b) by 0 days.

(21) Appl. No.: 09/606,664

(22) Filed: Jun. 28, 2000

(51) Int. Cl.[7] ..... H01J 11/04

(52) U.S. Cl. ..... 315/340; 315/344; 315/291; 315/39; 315/111.41

(58) Field of Search ..... 315/111.21, 111.81, 315/111.41, 39, 338, 340, 344, 291

(56) References Cited

U.S. PATENT DOCUMENTS

| | | | | |
|---|---|---|---|---|
| 4,596,945 | * | 6/1986 | Schumacher et al. | 315/344 |
| 4,721,891 | * | 1/1988 | Krause | 315/340 |
| 4,727,298 | | 2/1988 | Mendel | 315/340 |
| 4,812,715 | | 3/1989 | Mendel | 315/340 |

OTHER PUBLICATIONS

M. E. Savage, C. W. Mendel, Jr., D. B. Seidel, and R. W. Shoup, *Design of a Command–Triggered Plasma Opening Switch for Terawatt Applications*, Presented at the 12th IEEE International Pulsed Power Conference, Jun. 28, 1999.

* cited by examiner

*Primary Examiner*—Haissa Philogene
(74) *Attorney, Agent, or Firm*—Gregory A. Core; Timothy D. Stanley

(57) ABSTRACT

A command triggered plasma opening switch assembly using an amplification stage. The assembly surrounds a coaxial transmission line and has a main plasma opening switch (POS) close to the load and a trigger POS upstream from the main POS. The trigger POS establishes two different current pathways through the assembly depended on whether it has received a trigger current pulse. The initial pathway has both POS's with plasma between their anodes and cathodes to form a short across the transmission line and isolating the load. The final current pathway is formed when the trigger POS receives a trigger current pulse which energizes its fast coil to push the conductive plasma out from between its anode and cathode, allowing the main transmission line current to pass to the fast coil of the main POS, thus pushing its plasma out the way so as to establish a direct current pathway to the load.

11 Claims, 6 Drawing Sheets trigger in
32
trigger switch
fast coil
plasma
31
trigger switch
36
plasma
33
32
main switch
fast coil
35
main switch
30
cathode
power in
power out
34
anode pulse-forming line (4 pl)
oil
trigger power
trigger power
vacuum insulator
trigger switch
vacuum
plasma
plasma
applied field coil
vanes
fast coil
plasma sources
vanes
storage current
cathode
main switch
fast coil
plasma
to load
anode
conductor
vanes
applied field coil
plasma sources

PLASMA OPENING SWITCH

STATEMENT REGARDING FEDERALLY SPONSORED RESEARCH

This invention was made with Government support under Contract DE-AC04-94AL85000 awarded by the U.S. Department of Energy. The Government as certain rights in the invention.

CROSS REFERENCE TO RELATED APPLICATIONS

Not applicable.

BACKGROUND OF THE INVENTION

This invention relates to pulsed power machines and systems. More particularly, this invention relates to plasma opening switches that typically connect the pulse forming and storage stages of an inductive energy storage system to the output load in a very short time interval. Still more particularly, this invention relates to a command triggered, two stage plasma opening switch (POS).

The well-known advantages of inductive energy storage could allow smaller and more efficient pulsed-power drivers. Inductive energy storage systems allow lower voltage at the vacuum interface; the water pulse-compression elements and vacuum interface are significant cost and size items in high-power drivers. Because the opening switch is the point of highest voltage in an inductive storage design, it is the single most important part of such systems. An efficient opening switch that operates in vacuum, close to the load would have many applications. Such a switch can use the inductance associated with the vacuum interface to advantage as energy storage.

Since its invention, the plasma opening switch (see C. W. Mendel, Jr. and S. A. Goldstein, "A fast-opening switch for use in REB diode experiments," J. AppI Phys., vol. 48, pp. 1004–1006, 1977) has been studied as an attractive pulse-compression element for pulsed-power applications (see "Special issue on fast opening vacuum switches," IEEE Trans. Plasma Sci., vol. PS-15, 1987). A POS exploits the fact that plasma is an excellent conductor with low mass. The mass is important because the plasma must be moved rapidly to open the switch, and lower mass conductors require less energy to move quickly. The fact that the POS operates in vacuum also allows magnetic insulation, with higher insulation strength than any other dielectric.

Though widely studied, application of the plasma opening switch has met with limited success in demanding applications (those requiring both long conduction and fast opening). One basic reason is the lack of a strong, abrupt mechanism for opening in the standard POS. The only force at work in the standard POS is the drive current magnetic field. This field is slow-rising compared to the desired opening time, and is almost constant near peak current (maximum stored energy). For opening, rapid removal of plasma from the switch region is necessary. An independent mechanism that quickly removes plasma from the switch region would improve POS performance.

The advantages of a command-triggered switch are clear. In particular, since a POS will be the final stage of pulse compression, command-triggering would assure low jitter from the POS, and removal of jitter from upstream elements. This is unique; command triggering of the final pulse compression stage has not been demonstrated in large pulsers using water-dielectric closing switches or elsewhere.

The standard POS is realized by injecting plasma from an external plasma source into the anode-cathode gap of a magnetically insulated transmission line. FIG. 1 shows schematically a simplified plasma opening switch.

The plasma short-circuits the transmission line, allowing magnetic energy to accumulate in the storage inductance upstream of the plasma opening switch. When the POS opens, the stored magnetic energy transfers to the load. There are two effects that cause the initially closed POS to open. First, there is a magnetic pressure from the storage inductor current pushing on the plasma (which has no tensile or shear strength). Second, there is ion depletion from the plasma due to voltage between the plasma and the cathode. At typical plasma densities and magnetic fields, ion erosion is a relatively small effect. Unless field penetration is severe (see below), it is the magnetic force from the storage inductor current that causes opening in a conventional POS (see B. V. Weber, R. J. Commisso, P. J. Goodrich, J. M. Grossman, D. D. Hinshelwood, P. F. Ottinger, and S. B. Swanekamp, "Plasma opening switch conduction scaling," Phys. Plasmas, vol. 2, pp. 3893–3901, 1995). The switch opens, rather than simply translating a slug of plasma, largely because the plasma mass density is non-uniform across the gap. The non-uniform plasma mass density causes an axial component to the current sheet, with a corresponding radial force on the plasma. To a lesser extent, there is plasma shearing due to the variation of magnetic field with radius in the coaxial transmission lines typically used. Because the opening mechanism (storage inductor current) is applied continuously while the switch is closed, it is solely plasma inertia that keeps the conventional switch closed. This means that keeping a switch closed for longer times requires higher plasma mass. For a given conventional POS geometry and drive current, the opening rate will be inversely proportional to conduction time.

While the plasma is conducting current, it is possible for the drive current magnetic field to penetrate into the plasma. This happens when current passes through plasma and the cathode surface emits electrons. The penetration mechanism is replacement of plasma electrons with flux-carrying electrons emitted from the cathode conductor. Because these electrons essentially drift in the E×B direction, this is often called Hall penetration (see A. S. Kingsep, Y. V. Mokhov, and K. V. Chukbar, "Nonlinear skin effect in plasmas," Sov. J. Plasma Phys., vol.10, pp. 495–499,1984 and S. B. Swanekamp, J. M. Grossman, A. Fruchtman, B. V. Oliver, and P. F. Ottinger, "Particle-in-cell simulations of fast magnetic field penetration into plasma due to the Hall electric field, " Phys. Plasma, vol. 3, pp. 3556–3563, 1996). An understanding of field penetration is important for determining the plasma density required for the triggered switch concept.

Since the electrons in the injected plasma have zero canonical angular momentum, magnetic field cannot penetrate into that region unless the electrons are pushed away (bulk plasma translation) or replaced, since there is negligible momentum transfer from electrons to the ions. However, electrons emitted from the cathode can have non-zero canonical angular momentum because of momentum transfer to the cathode conductor. Magnetic field penetrates the plasma at the rate plasma electrons are replaced. Since both plasma electrons and cathode electrons carry current, the penetration rate varies with time. The velocity of the replacement front (penetration) is:

$$v = \frac{I_{pe}}{2\pi r \cdot n_e e \cdot g} \quad (1)$$

Here $I_{pe}$ is the current in plasma electrons only, r is the average switch radius, $n_e$ is the plasma electron density, e is the electron charge, and g is the mechanical gap in the switch region. Initially, plasma electrons carry the entire generator current. As the plasma electrons are replaced, cathode electrons carry more current and the penetration slows.

Assuming that the penetration rate is proportional to the number of plasma electrons remaining, one can derive an expression for the position of the magnetic field penetration front as a function of time:

$$x(t) = x_0\left[1 - \exp\left(-\int_o^t \frac{I_{gen}}{Q_p}\, d\tau\right)\right] \quad (2)$$

with $$Q_p = 2\pi r \cdot n_e e \cdot g \cdot x_0 \quad (3)$$

x is the distance into the plasma region into which field has penetrated, $I_{gen}$ is the generator current, and $x_0$ is the initial axial length of the plasma. $Q_p$ is the total ion charge in the plasma. The combined charge of plasma electrons and beam electrons is equal and opposite to the ion charge. The plasma ion charge changes (though usually not dramatically) as ions leave the plasma. This approximation assumes the plasma mass distribution is unchanging. Compared to particle-in-cell simulation data, this simple model somewhat overpredicts the replacement rate because cathode electrons carry a higher fraction of current than the ratio of cathode electrons to total electrons.

The magnetic field penetration time constant, $$\tau_p = \frac{Q_{plasma}}{I_{generator}} \quad (4)$$

gives the exponential folding time based on the above model. At one time constant, the magnetic field has penetrated approximately 37 percent of the axial length of the plasma.

For a coaxial switch of 10-cm radius, 5-cm electrode gap, and axial switch length of 15 cm, and doubly ionized plasma at $10^{21}$ ions/m$^3$, the penetration time constant is 1.5 $\mu$s at 1 MA drive current. Thus in such an experiment with 500 ns or longer drive time, there is considerable plasma mass left behind the magnetic piston. The voltage in the switch region cannot rise appreciably until the charge density in the gap decreases much below the initial density. These ions can only be removed by acceleration across an electric sheath, at the expense of more energy than sweeping them in a magnetic snowplow. Increasing the plasma ion number density reduces field penetration but raises the mass that must be moved for opening. A viable approach to improving opening switch performance would be to reduce the opening field rise time so that penetration is unimportant for reasonable plasma densities.

Another important vacuum opening switch parameter is the amount the switch opens. The fraction of the anode-cathode gap cleared of plasma determines the efficiency of the POS. One way to infer the effective gap cleared of plasma is to measure voltage and electron flow downstream of the POS and compute the consistent vacuum impedance. This technique is a flow impedance (see C. W. Mendel, Jr. and S. E. Rosenthal, "modeling magnetically insulated devices using flow impedance," Phys. Plasmas, vol. 2, pp. 1332–1342, 1995 and C. W. Mendel, Jr., M. E. Savage, D. M. Zagar, W. W. Simpson, T. W. Grasser, and J. P. Quintenz, "Experiments on a current-toggled plasma-opening switch," J. Appl. Phys., vol. 71, pp. 3731–3746, 1992) calculation. The flow impedance of a section of magnetically insulated transmission line is $$Z_f = \frac{V}{\sqrt{I_{ua}^2 - I_{dc}^2}} \quad (5)$$

where $Z_f$ is the flow impedance, V is the voltage, $I_{ua}$ is the anode current upstream of the section and $I_{dc}$ is the cathode current downstream of the section.

Flow impedance considers axial electron flow, which is important in magnetically insulated systems. For this reason, flow impedance may be used as a measure of opening switch performance, instead of other commonly used parameters such as voltage or resistance. For efficiency, the effective impedance of the opening switch must be higher than the load impedance, so it is the load and not the opening switch that determines voltage. Another common technique is modeling the POS as a radial resistor. This is not generally useful because the calculated resistance varies dramatically with both load impedance and current monitor location, due to axial current in vacuum-flowing electrons. Flow impedance is equally valid in situations where there is externally applied magnetic fields (see C. W. Mendel, Jr., J. P. Quintenz, S. E. Rosenthal, D. B. Seidel, R. Coats, and M. E. Savage, "Experiments on insulation of relativistic electron flows in oblique magnetic fields," IEEE Trans. Plasma Sci., vol. 17, pp. 797–800, 1989).

A desirable opening switch for an inductive energy store system is one that opens quickly compared to the output pulse width, and opens far enough to allow efficient energy transfer to the load. Further, since the POS is the final stage of pulse compression, a system that allows temporal synchronization of the output pulse is also desirable. The command-triggered plasma opening switch described below is designed to improve performance as well as introduce the ability to actively trigger its opening.

SUMMARY OF THE INVENTION

The command triggered, two stage plasma opening switch of this invention comprises a main POS located across the anode and cathode of the main transmission line, just upstream from the load, and a command triggered POS that very rapidly switches the main driver current into a fast coil in the main POS, quickly moving the plasma away from the anode-cathode gap in the main transmission line. This acts to remove the short circuit between the anode and cathode in the main transmission line previously created by the presence of the plasma in the main POS and allows the full power of the system to be transferred to the load.

The construction and operation of the POS, and its theory of operation are presented in more detail below.

DETAILED DESCRIPTION OF THE INVENTION

Past experiments used fast magnetic fields to enhance opening. The current-toggle POS (see Mendel, Jr. et al. 1992 above) used a magnetic field coil energized by cathode current downstream of the opening switch. Later experiments (the magnetically controlled POS [ see M. E. Savage, E. R. Hong, W. W. Simpson, and M. A. Usher, "Plasma opening switch experiments at Sandia National Laboratories," presented at $10^{th}$ International Conference on High Power Particle Beams, San Diego, Calif., 1994]) used a conventional plasma opening switch diverting storage inductor into the fast coil. Since storage inductor current is higher than cathode current downstream of the opening switch, the magnetically controlled POS has an advantage over the current toggle POS. Both concepts rely on the fact that at typical plasma densities and magnetic fields, it is magnetic pressure that causes a POS to open. The MCPOS (M. E. Savage 1994 above) uses an additional magnetic field created by diverting storage inductor current into a helical coil assembly located in the switch region; when so diverted this coil is in series with the storage inductor cathode. The inductance of this coil is small compared to the storage inductance, but raises the magnetic field by a factor of 3 in the switch region. This gives nearly an order of magnitude higher magnetic field pressure on the plasma, which increases the amount and speed the switch opens. This additional field is zero until the helical field coil is energized, and then ideally rises much faster than the storage inductor current. One of the improvements comprising the invention herein is to drive the fast coil with an external pulser.

Figure 1:
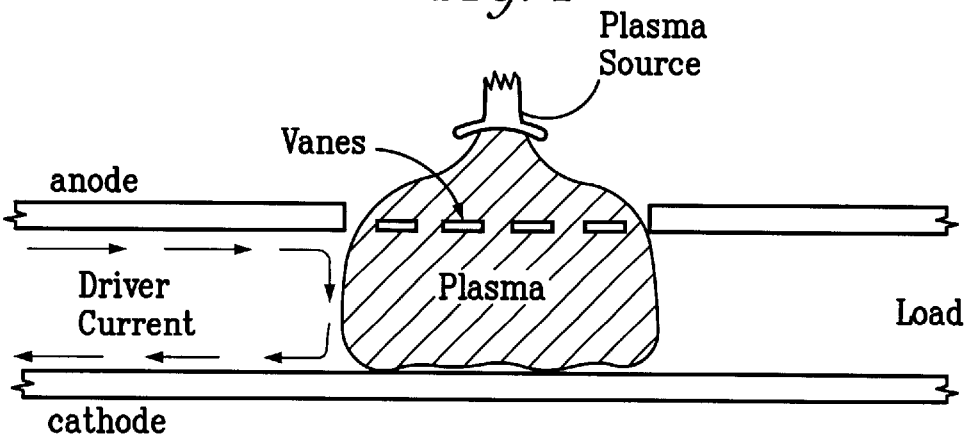
FIG. 1 is a cross sectional view of a simplified conventional plasma opening switch.
Figure 2:
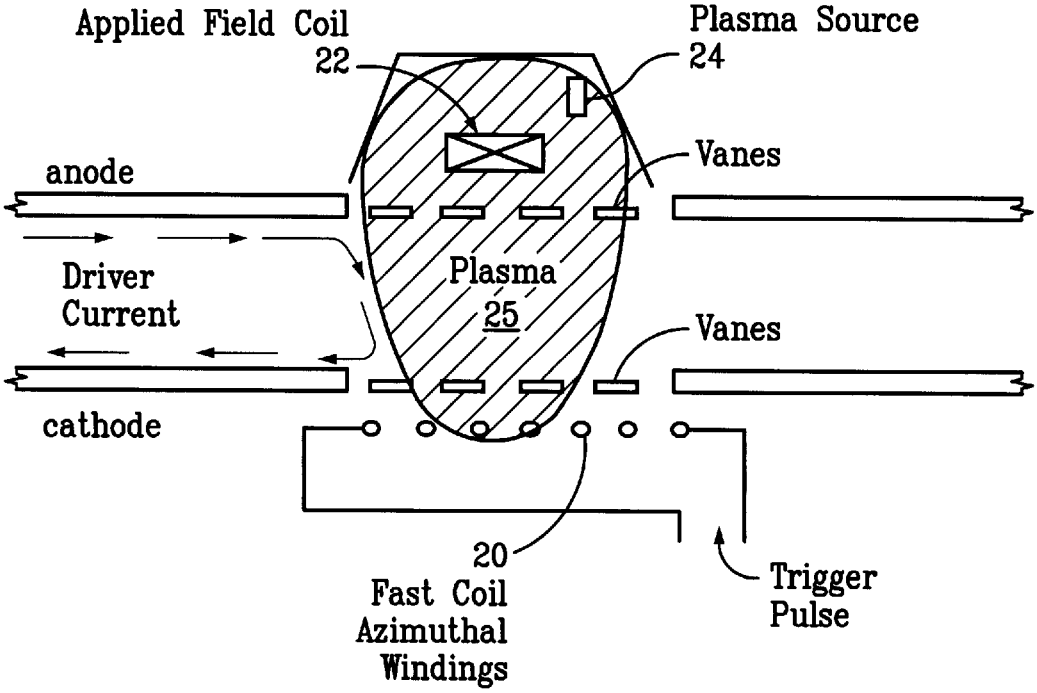
FIG. 2 is a cross sectional view of a single stage, triggered plasma opening switch showing how the short circuit is created between the anode and cathode of the main transmission line by the plasma created by the plasma sources and the applied field (slow) coil. The fast coil, when triggered, will remove the short circuit by pushing the plasma away from the cathode and removing the short circuit. A coaxial switch would have the axis of symmetry horizontal in this figure; a planar switch would have the symmetry axis vertical.

FIG. 2 shows the concept of the command-triggered plasma opening switch. An applied magnetic field (with a peak axial field at the cathode 30–60 percent of the peak drive current field at the cathode) guides plasma into the transmission line anode-cathode gap. This applied field is supplied in a millisecond time scale, which requires a few kilovolts. This field also holds the plasma in place, countering the impulse from the drive current pressure. It is important to note here that plasma injection along magnetic field lines is effective only if the plasma is sufficiently uniform in the azimuthal direction. It is the azimuthal eddy current that prevents plasma from crossing the applied field coil flux lines. Until plasma from individual sources connect, forming an azimuthal ring, the plasma drifts freely, crossing field lines. Assuming a nominal 45 degree plasma expansion angle from the plasma sources, the distance between individual plasma sources must be somewhat less than the distance from the plasma source to the applied field flux excluder. Also, for uniform plasma fill in the transmission line region, the total plasma drift distance should be much greater than the plasma source separation. For example, a switch of 34 cm radius requires hundreds of sources. For convenience, these are usually made from multiple sparks (0.75 mm gaps) on a section of standard circuit-board material. Six or more sparks can be driven from a 10 kV, 50 nF circuit; many such circuits are in parallel for the entire system. This forms the uniform, distributed plasma source necessary for this plasma fill technique.

While the plasma conducts the driver current, electron replacement field penetration occurs to some extent; however, the plasma density will be chosen such that the voltage drop (due to a sheath caused by ion erosion) will be less than a few kilovolts before the switch opens. FIG. 2 shows the state where an applied magnetic field holds plasma in place during conduction. The closed condition is shown. A coaxial switch would have the axis of symmetry horizontal in the above figure; a planar switch would have the symmetry axis vertical.

Application of the trigger pulse energizes the azimuthal windings (the 'fast coil'). This azimuthal current induces an eddy current on the plasma surface. Here too, an azimuthally uniform plasma is vital. The force on the plasma comes from the eddy current induced in the plasma. If the plasma is not azimuthally continuous, this eddy current cannot flow.

The trigger field has a rise time five to ten times faster than the storage inductor current. Whereas the storage inductor current might have penetrated substantially into the plasma, the trigger field penetration is negligible because of its relatively fast rise time. This separation of conduction and opening is a central part of this work.

Opening a POS by this method would be effective, yet it will be seen below that the trigger energy depends strongly on the amount the switch is opened. A high-performance system is one in which the POS opens relatively far, and fast. For this reason, this system uses a stage of amplification. The fast coil drive power is less than the load power; this system has power gain. Therefore, the trigger power can be reduced with an additional stage. The system described here is one in which the triggered switch diverts storage inductor current into the fast coil of a second plasma opening switch. The gain of this system reduces the required trigger power significantly.

Figure 3:
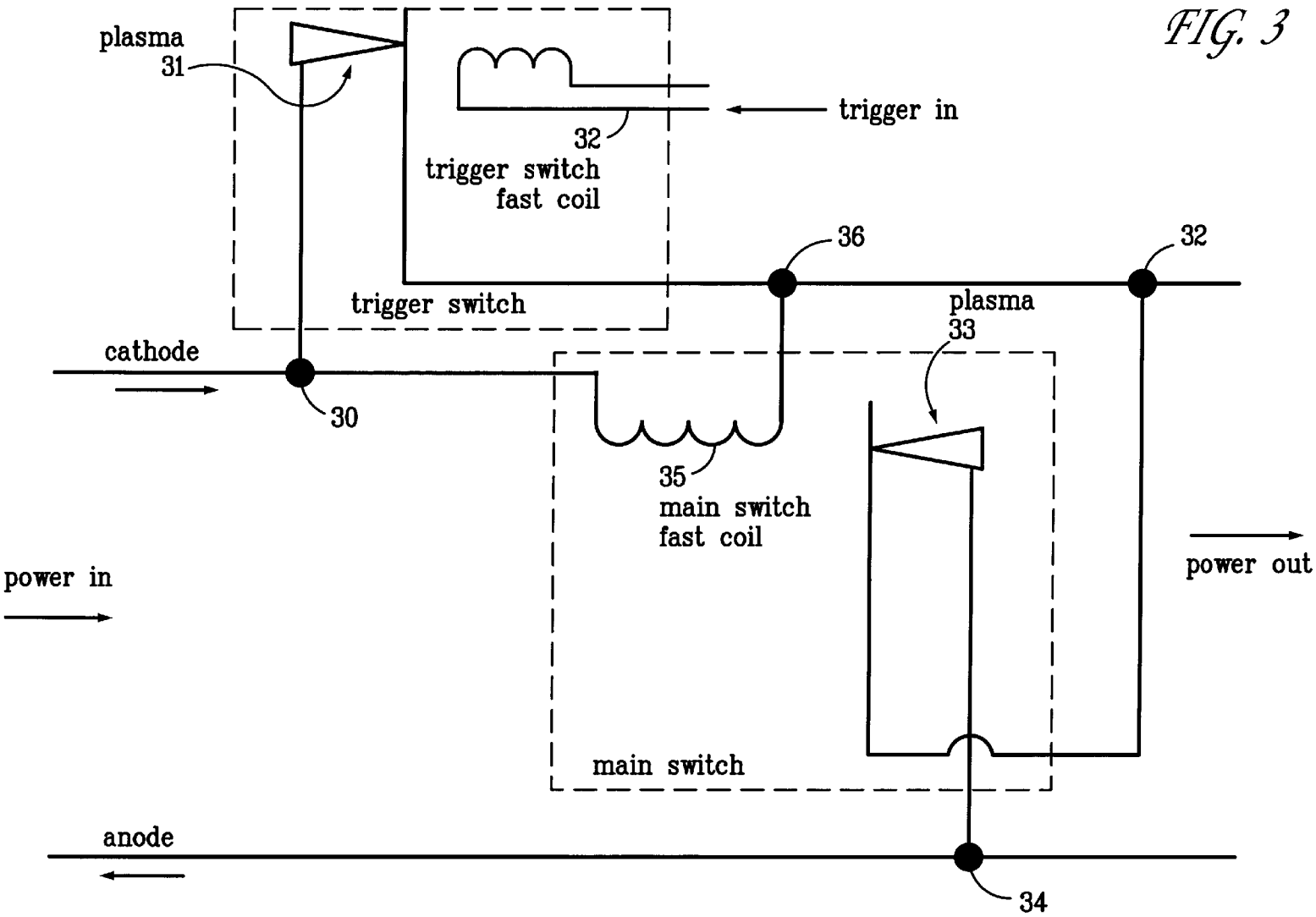
FIG. 3 is a schematic diagram of the command triggered POS of this invention.

FIG. 3 is a schematic diagram that shows the high level operation of this two stage POS assembly. Prior to opening the switch and transferring the transmission line power to the load, both the trigger POS and main POS have injected plasmas that are shorting the anode and cathode such that no current can reach the load. The cathode current turns up into the trigger POS where the plasma 31 established a current pathway down to junction 32 where the current again shorts through the main POS plasma 33 and on down to the anode at junction 34. Once the trigger POS receives its trigger pulse, its fast coil 32 is energized, pushing the plasma 31 back and breaking that current path. As a result the current now goes past node 30 into the main POS fast coil 35. As this fast coil is energized it drives back the plasma 33 and takes away that current path to the anode. The current now flows through the main POS fast coil, through nodes 36 and 32 and on to the load.

Figure 4:
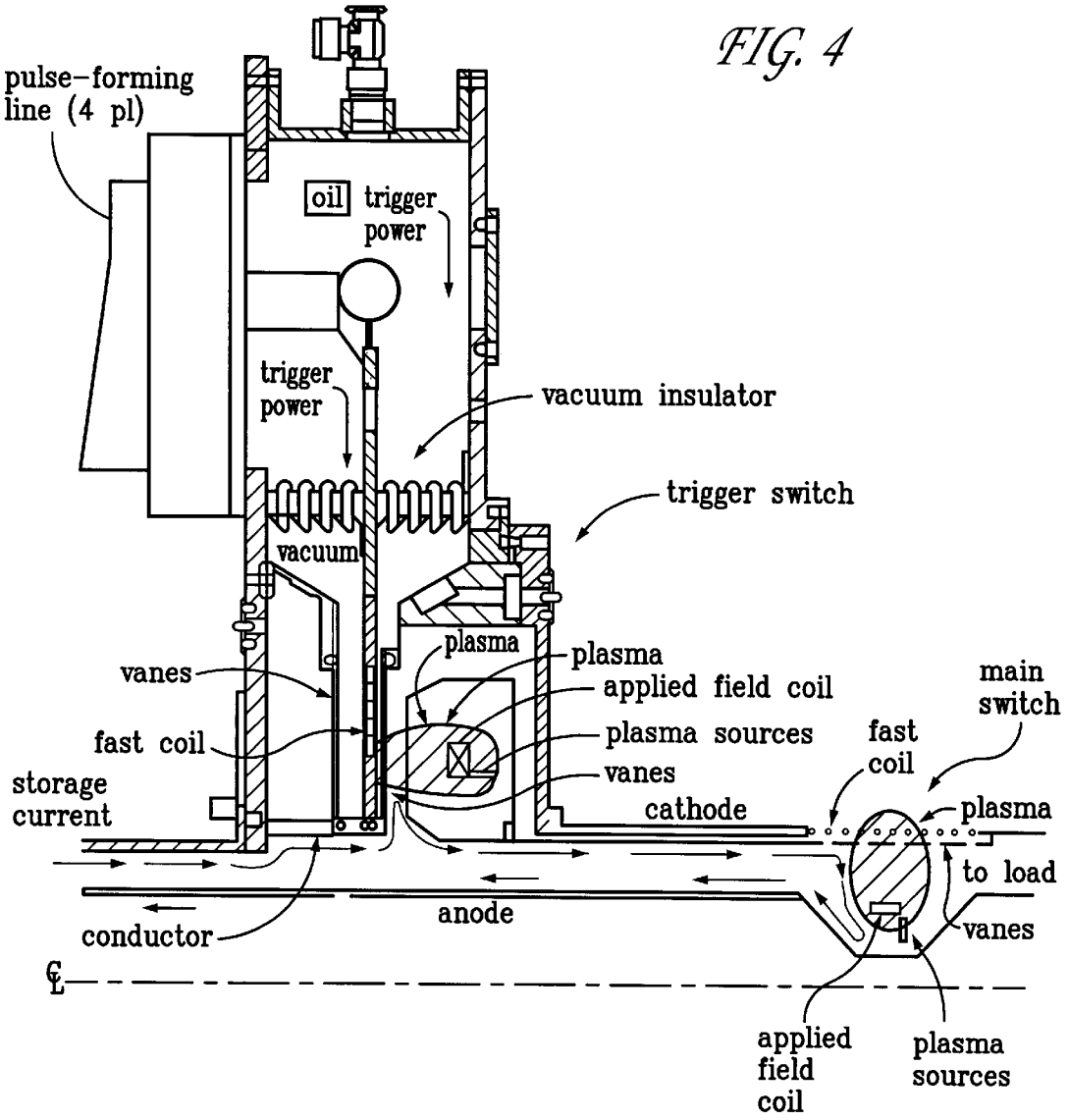
FIG. 4 is a cross sectional view of one embodiment of the POS at a time when plasma in both the main and trigger POS's are creating short circuits and causing the current to flow as shown.
Figure 5:
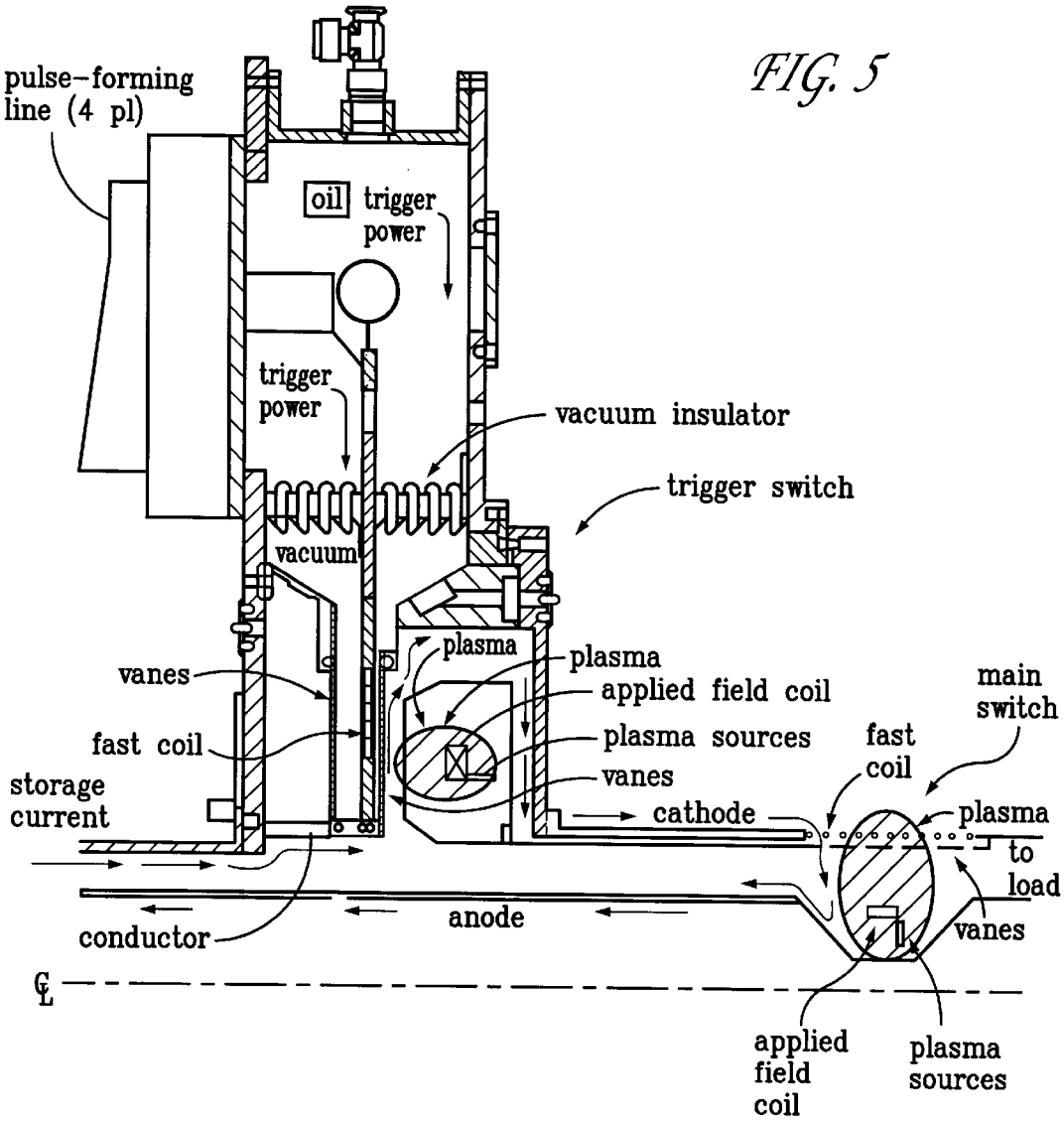
FIG. 5 is a cross sectional view of the POS of FIG. 4 at a later stage where the trigger POS has been triggered, its plasma moved away by its fast coil, and a new current pathway created.
Figure 6:
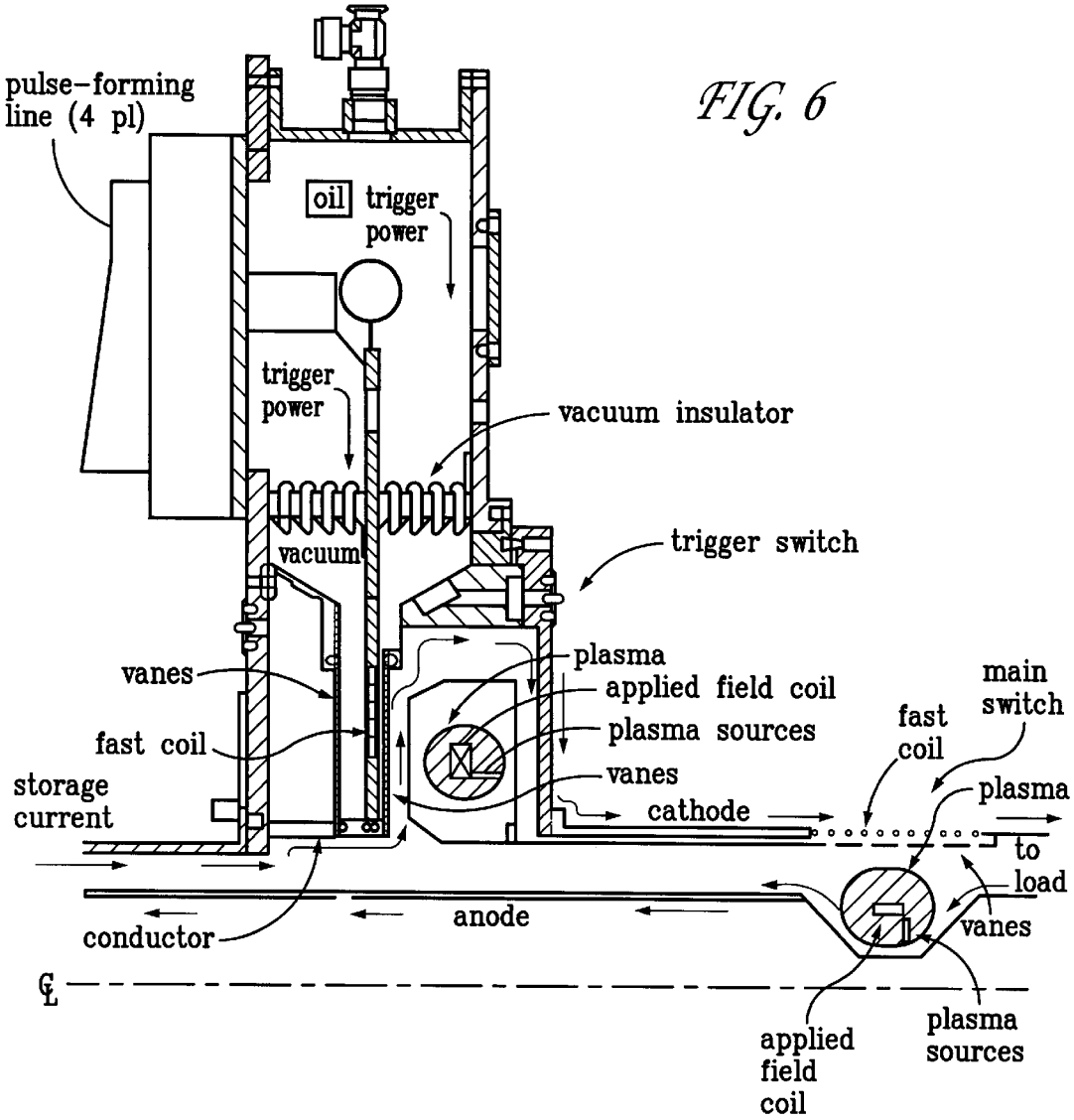
FIG. 6 is a cross sectional view of the POS of FIGS. 4 and 5 at an even later stage in which both POS's have had their plasmas moved away, and the anode and cathode are now connected to the load.

FIGS. 4, 5 and 6 illustrate how this schematic process could translate into one physical embodiment of the invention. FIG. 4 shows the initial condition where the plasmas in both the trigger POS and the main POS have been generated by their respective plasma sources and applied field coils such that the plasmas have established shorts as shown by the arrows adjacent the cathode and anode. FIG. 5 shows an intermediate condition wherein the trigger pulse to the trigger POS has driven the plasma away from the vane conductor and established a new current path to the main POS fast coil. At this very brief instant, the main POS fast coil has not yet been energized, and there is still enough plasma in the main POS to maintain the short. In FIG. 6, the switch assembly has completely opened with the plasma in the main POS now being pushed back by its fast coil. The current now proceeds to the load.

It should be noted that these POS assemblies surround the circumference of the coaxial transmission line. Although the assemblies shown here have a coaxially disposed main POS and a radially disposed trigger POS, these orientations maybe interchanged or made the same, depending upon the particular usage at hand.

Calculations

A set of calculations shows the approximate energy required to trigger the switch. Because of the fast rise time of the trigger field, we will ignore field penetration.

The first requirement is that the magnetic field pressure be adequate to push the plasma. A pressure-balance calculation shows that the magnetic field must be $$B \geq v_{sheath}\sqrt{2\mu_0 n_0 m_i}\,. \tag{6}$$

Here B is the magnetic field at the plasma surface, $v_{sheath}$ is the magnetic piston velocity, $\mu_0$ is the permeability of space, $n_0$ and $m_i$ are the plasma number density and ion mass, respectively. Note that the plasma density required stems from having enough ion charge in the gap so that erosion is not the dominant opening mechanism; equivalently, the penetration time constant, $\tau_p$ at peak current should be at least comparable to the conduction time. This plasma density (in conjunction with the applied magnetic field holding plasma in place) assures that the switch will not self-open. Because the trigger field rise time is much faster that the storage inductor pulse, this density also assures that field penetration of the trigger pulse will be negligible. With the plasma density so determined, and a sheath velocity consistent with 2 cm in 50 ns, the magnetic field must be about 0.5T, for the case of 1 megampere storage current rising in 250 nanoseconds.

Second, the trigger pulser must supply the energy to move the plasma and fill the volume with magnetic field. With a constant magnetic field $B_0$, the energy to increase the field volume is $$E = \eta\frac{B_0^2}{\mu_0}Vol, \tag{7}$$

with $$\tfrac{1}{2} \leq \eta \leq 1 \tag{8}$$

Vol is the plasma volume. The factor η depends upon the final energy distribution between kinetic and magnetic energy; for a fast-moving system η will be closer to 1. Using a constant 0.5T from Eq.
Error! Reference source not found. and the 16 liter plasma volume (especially with plasma present, the magnetic field energy is concentrated near the fast coil), the maximum energy is 3.2 kJ. In actuality the entire plasma volume will not be displaced. To judge the value of an additional stage, we can use Eq.
Error! Reference source not found. to compute the energy needed for the main switch. The main switch must open farther and faster; using an amplifier stage allows triggering with 3.2 kJ instead of the 14 kJ required by the main switch.

With this estimate of the driver requirements, the system design could begin. The fast field coil could be designed with a magnetostatic model because of negligible field penetration. A planar coil with 28 vanes in parallel, each making a quarter-turn gives a vacuum inductance of 32 nH. The coil is constant-pitch; the vanes have the same angle from radial across the radial extent of the coil. With plasma pushed completely out of the gap, achieving 0.5 T at the anode requires 430 kA in this coil. The vacuum magnetic field energy at 430 kA is 3 kJ.

Trigger Design

The trigger pulser supplies the current that energizes the fast field coil. The resulting magnetic field applies a force to the plasma, which causes opening. As shown before, the energy required is a few kilojoules in 50 ns. This is approximately 0.06 TW. Present technology makes this readily available. Since this is a basic experiment, the pulser design allowed for more than the minimum energy. The pulser uses available components from other experiments. A 24-stage, 100 kV Marx generator charges two parallel 7.5 nF water capacitors. A megavolt gas switch transfers this energy into four parallel 7.8Ω water pulse-forming lines. The pulse-forming lines use self-closing water switches. The output of these pulse-forming lines feeds through a graded vacuum interface into the fast coil. This pulser can supply more than 800 kA within 50 ns into the 32 nH fast coil and has over 20 kJ available.

Mechanical Design

FIGS. 4, 5 and 6 show the layout and operation of the triggered POS in detail. This trigger switch is a planar design; trigger power flows radially inward. The main switch in the Figures is coaxial design. The storage inductor is a 17Ω coaxial vacuum line (not shown) on the left side of the figure. The load is an electron-beam diode (also not shown) to the right of the figure. Typical load impedance ranges from 6–12Ω. The storage inductance is 250 nH and the peak current is 800–900 kA. The goal is to energize the main (second) POS fast coil in 10–20 ns.

Simulations

Particle-in-Cell simulations of the command-triggered POS were done using the 2½ D code TwoQuick (see J. P. Quintenz, D. B. Seidel, M. L. Kiefer, T. D. Pointon, R. S. Coats, S. E. Rosenthal, T. A. Mehlhorn, M. P. Desjarlais, and N. A. Drall, "simulation Codes for light-ion modeling," Laser and Particle Beams, vol.12, pp. 283–324,1994). Particle in cell simulations accurately model the low densities at opening, and the electron flow after opening. Single-fluid magnetohydrodynamic models can represent neither. Scaling is done using well-understood parameters related to considerations such as numerical electron heating and electron replacement (Hall penetration).

A new model was added to TwoQuick that uses a tensor conductivity layer in the plane of the fast coil to account for the fast coil current. With an appropriate conductivity tensor function, this model represents the correct amount of azimuthal current in the fast coil region. These simulations included the double-sided fast coil feed as in the experiment, and use an electron diode load in place of the fast coil of the main switch. To calculate the simulations on a practical time scale, and to avoid problems due to numerical heating, the simulations are run on a time scale about one order of magnitude faster than the experiment. Scaling is done using equation Errorl Reference source not found., which says that opening rate is proportional to the square root of mass density and inversely proportional to magnetic field. The plasma mass density is about two orders of magnitude lower with 1.0 $C/m^3$, 1 AMU ions (the experiment will use 16 $C/m^3$ and average atomic mass of 8). Note that 1 $C/m^3$ corresponds to $6.25 \cdot 10^{12}$ electrons per cubic cm. The drive current is 0.5 MA, which is about half that of the experiment. The cell size in the plasma region is 0.5 mm and is chosen as a compromise between acceptable numerical heating and reasonable simulation cost.

Figure 7:
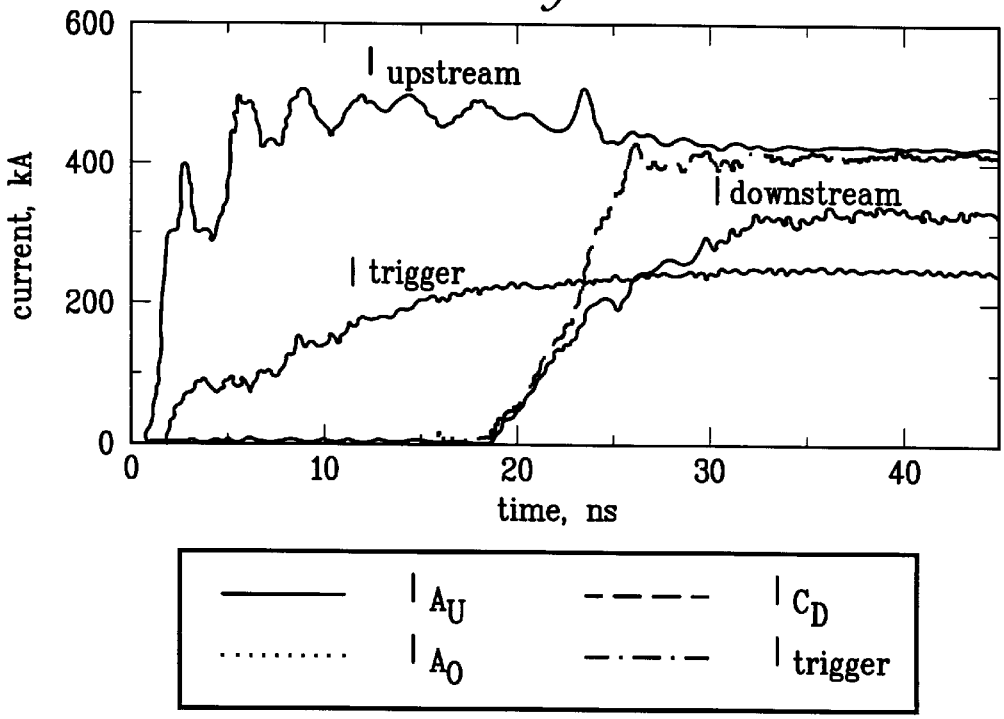
FIG. 7 is a graph showing the simulated currents in the POS as a function of time.

FIG. 7 shows the upstream anode current, the downstream anode and cathode currents, and the fast coil (trigger) current from the simulation. For this simulation, the driver voltage is a step wave with one nanosecond risetime. The slow field is 0.2 T at the cathode surface. For comparison, the peak azimuthal magnetic field due to storage inductor current at this location is 0.3T. The trigger signal to the fast coil has a short-circuit current of 0.25 MA. It begins to rise at 1.0 ns after the simulation begins, but does not reach appreciable current until about 15 ns. The fast coil rise time is a factor of three faster than the fast coil rise time expected in the experiment. The data shown in FIG. 7 give a flow impedance that reaches well above 3.0Ω. This is quite good considering the 4.0Ω vacuum impedance downstream of the switch.

To test for contributions to opening from non-physical (numerical) effects, the fast coil drive was delayed to 10 ns, i.e. 9 ns later than above. Nothing else was changed. The delayed fast coil trigger signal resulted in a delayed switch opening by 9 ns (measured by flow impedance), but the rate of rise and the level of opening remained the same. If numerical heating of the plasma were an important contributor to the simulation results, significant differences would be expected in this comparison.

For efficiency and cost reasons it is desirable to minimize the trigger current supplied to the fast coil. To understand the effect of varying this current, simulations were performed at three trigger current levels: 125 kA, 250 kA, and 500 kA (25%, 50%, and 100% of drive current). In all cases the slow field was adjusted in proportion to the trigger current. In each simulation, the flow impedance reaches about 3.5Ω, however the 125 kA case takes significantly longer to open. The 500 kA case opens slightly faster than the 250 kA case, but not enough faster to be worth the cost. It is likely that a current lower than 250 kA would suffice, but 125 kA appears to be too low.

Figure 8:
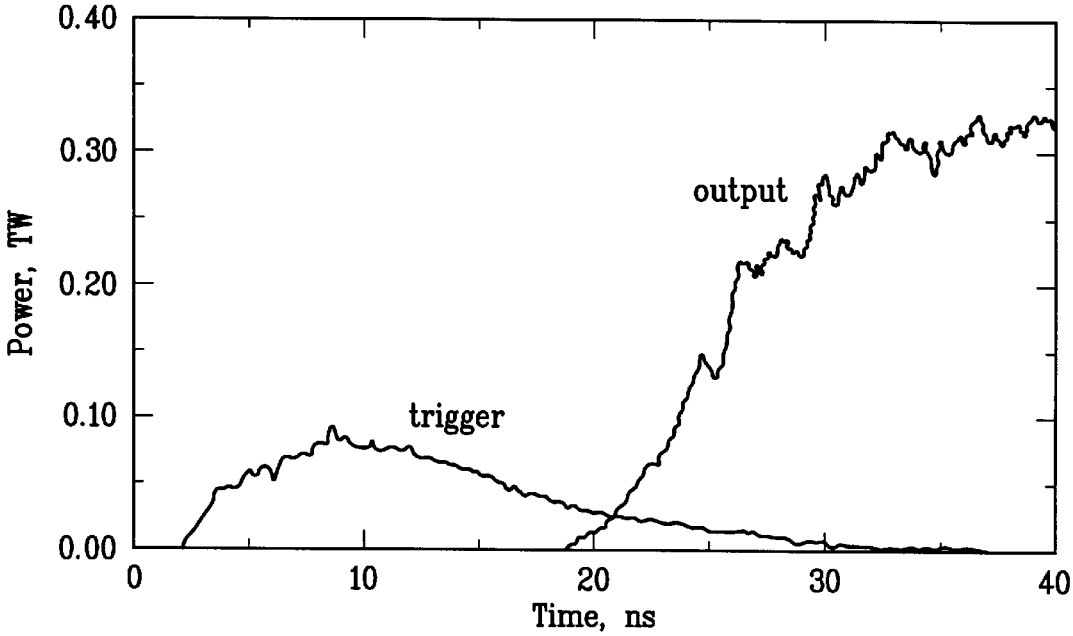
FIG. 8 is a graph showing the simulated power of the trigger pulse and the power out of the trigger POS as a function of time for a 250 kA trigger fast coil current.

The simulations show the relative power needed to trigger the switch and the power delivered out of the switch. FIG. 8 shows the simulation power delivered from the trigger pulser (for 250 kA trigger current) and the power delivered out of the trigger switch. This gain of three in power demonstrates the advantage of two stages.

As discussed earlier, flow impedance is an important metric of switch performance. To demonstrate this, the 250 kA trigger current case was repeated, varying only the gap of the load diode. The gaps chosen for the three simulations performed correspond to 1.45Ω, 2.67Ω, and 4.00Ω load impedance, respectively. FIG. 7 shows the flow impedance for these three cases. The 1.45Ω load impedance data are noisy because the denominators involve a small difference between two large signals. Clearly, the figure shows that the switch flow impedance is independent of the load impedance. In contrast to the flow impedance, the switch impedance is seen to change drastically with load impedance. Clearly flow impedance is a better metric for a POS and supports the theoretical prediction that the switch flow impedance should be independent of load impedance.

Physical considerations and computer modeling show that a command-triggered plasma opening switch is practical. This switch has advantages in its separation of conduction and opening. The independent trigger has a rise time fast enough to avoid detrimental field penetration due to electron replacement. Because each stage of this system has power gain, using a POS as an amplifier reduces the required trigger power. With this amplification, the required trigger energy will be a few kJ for a 100 kJ system.

The expected performance of the trigger stage would rapidly switch all the storage inductor current into the main switch fast coil, providing the needed large and fast-rising magnetic pressure for rapid opening of that switch.

The simulations indicate that the balance in radial position and in magnetic field strengths between the fast and slow coils is important for obtaining high open flow impedance. The switch, when properly designed, appears to have excellent open flow impedance and opening speed. Simulation data show dramatically that the critical parameter of such a switch is the flow impedance, which is found to be independent of load impedance, whereas the switch resistance varies greatly depending upon the load. The loads can include devices to produce photons and charged particle beams that can be used for materials processing, electromagnetic sterilization and radiography.

What is claimed is:

1. A switch assembly including a trigger plasma opening switch (POS) and a main POS that are circumferentially disposed about a power transmission line having outer and inner conductors and the assembly switchably connecting a load thereto, the assembly comprising:

a trigger POS and a main POS, both including an anode and a cathode, a plasma source, an applied field coil for guiding the plasma into a gap between the anode and the cathode and holding the plasma in place until triggering, and a fast coil for moving the plasma away from the fast coil;

wherein the trigger POS initially forms a plasma short across the trigger POS that shorts current to a vane conductor that is disposed across a gap in the outer conductor along a first current path to the main POS, that in turn shorts current across the main POS between the outer and inner conductors of the transmission line via its plasma, and, upon arrival of a trigger pulse to the trigger POS that activates its fast coil, pushes the plasma away to establish a second current path that leads the current in the outer conductor to the fast coil of the main POS, thus pushing the plasma away from this fast coil and removing the short between the outer and inner conductors to provide current to the load.

2. The assembly of claim 1 wherein a normal to the fast coil of the main POS is oriented perpendicular to the axis of the transmission line.

3. The assembly of claim 1 wherein the plane of the fast coil of the trigger POS is oriented perpendicular to the axis of the transmission line.

4. The assembly of claim 1 wherein the plasma source comprises a plurality of individual plasma generators spaced closely enough to create a plasma that uniformly fills the gap.

5. The assembly of claim 1 wherein the trigger pulse current is less than the current entering the fast coil of the main POS.

6. The assembly of claim 1 wherein the trigger pulse current is less than the current transferred to the fast coil of the main POS.

7. A command triggered, plasma opening switch (POS) assembly located between a source of electrical power and a load, comprising:

a coaxial power transmission line having an outer concentric conductor of a first polarity and an inner concentric conductor of a second polarity;

a main POS located close to the load and concentrically disposed about the outer and inner conductors and including and anode and a cathode, a plasma source, an applied field coil for guiding the plasma into a gap between the anode and the cathode and holding the plasma in place until triggering, and the fast coil to push the plasma out of the gap when energized with a vane conductor located parallel and adjacent thereto and facing the applied field coil; and a trigger POS located upstream from the main POS and concentrically disposed in a gap in the outer conductor and including a anode and a cathode, a plasma source, an applied field coil for guiding the plasma into a gap between the anode and the cathode and holding the plasma in place until triggering, and the fast coil to push the plasma out of the gap when energized by a trigger pulse and with a vane conductor located parallel and adjacent thereto and facing the applied field coil;

wherein, the trigger POS defines two current paths in the outer conductor depending upon whether its fast coil has been energized, the first current path prior to the trigger pulse is along the outer conductor to the plasma in the gap in the trigger POS that creates a plasma short through this POS to the vane conductor across a gap in the outer conductor at the main POS at which position a second plasma short is formed by the main POS to the inner conductor, and the second currrent path is formed upon energizing the fast coil in the trigger POS to remove the plasma short there and to connect the current across the vane conductor in the trigger POS directly to the fast coil in the main POS, thus removing the plasma short across the main POS and connecting the power transmission line to the load.

8. The assembly of claim 6 wherein the plane of the fast coil of the trigger POS is oriented perpendicular to the axis of the transmission line.

9. The assembly of claim 6 wherein the plasma source comprises a plurality of individual plasma generators spaced closely enough to create a plasma that uniformly fills the gap.

10. The assembly of claim 6 wherein a normal to the fast coil of the main POS is oriented perpendicular to the axis of the transmission line.

11. The assembly of claim 6 wherein the trigger pulse current is less than the current transferred to the fast coil of the main POS.

* * * * *